US012692864B2

(12) United States Patent
Dargham et al.

(10) Patent No.: US 12,692,864 B2
(45) Date of Patent: Jul. 28, 2026

(54) VARIABLE-SPEED REFRIGERATING SCROLL COMPRESSOR WITH AN OIL FLOW REGULATING DEVICE

(71) Applicant: DANFOSS COMMERCIAL COMPRESSORS, Trevoux (FR)

(72) Inventors: Remi Bou Dargham, Villeurbanne (FR); Arnaud Daussin, Trevoux (FR)

(73) Assignee: Danfoss Commercial Compressors, Reyrieux (FR)

( * ) Notice: Subject to any disclaimer, the term of this patent is extended or adjusted under 35 U.S.C. 154(b) by 0 days.

(21) Appl. No.: 18/910,666

(22) Filed: Oct. 9, 2024

(65) Prior Publication Data

US 2025/0129781 A1 Apr. 24, 2025

(30) Foreign Application Priority Data

Oct. 19, 2023 (FR) ..... 23/11340

(51) Int. Cl.

| | |
|---|---|
| ***F04C 18/02*** | (2006.01) |
| ***F04C 28/08*** | (2006.01) |
| ***F04C 29/02*** | (2006.01) |

(52) U.S. Cl.

CPC ..... *F04C 18/0215* (2013.01); *F04C 28/08* (2013.01); *F04C 29/02* (2013.01); *F04C 29/023* (2013.01); *F04C 29/028* (2013.01); *F04C 2240/40* (2013.01); *F04C 2240/60* (2013.01); *F04C 2270/051* (2013.01)

(58) Field of Classification Search

CPC ..... F04C 29/02–028; F04C 15/0088; F04C 18/0215–0292; F04C 2/025

See application file for complete search history.

(56) References Cited

U.S. PATENT DOCUMENTS

| | | | | |
|---|---|---|---|---|
| 2005/0025649 | A1* | 2/2005 | Hsia | F04C 29/0057 418/55.1 |
| 2009/0041603 | A1* | 2/2009 | Ginies | F04C 23/008 418/55.6 |
| 2022/0154719 | A1 | 5/2022 | Hirami et al. | |

FOREIGN PATENT DOCUMENTS

| | | | |
|---|---|---|---|
| CN | 201443509 | U | 4/2010 |
| FR | 2919688 | A1 | 2/2009 |
| FR | 2984425 | A1 | 6/2013 |
| JP | 2003-286976 | A | 10/2003 |

OTHER PUBLICATIONS

French Search Report for FR Application No. 2311340 dated Jun. 5, 2024.

* cited by examiner

*Primary Examiner* — Laert Dounis

(74) *Attorney, Agent, or Firm* — Carlson, Gaskey & Olds, P.C.

(57) ABSTRACT

A scroll compressor comprising a compressor casing; a compression unit including a fixed scroll and an orbiting scroll defining a compression volume; an oil sump; a drive shaft including a driving portion coupled with the orbiting scroll; a variable-speed electric motor configured to rotatably drive the drive shaft; an oil injection system including an oil feed channel fluidly connected to the oil sump and extending over the entire length of the drive shaft, and oil injection means provided on the orbiting scroll and configured to deliver oil from the oil feed channel to the compression volume; and an oil flow regulating device configured to regulate an oil flow from the oil feed channel to the oil injection means.

20 Claims, 4 Drawing Sheets

VARIABLE-SPEED REFRIGERATING SCROLL COMPRESSOR WITH AN OIL FLOW REGULATING DEVICE

CROSS-REFERENCE TO RELATED APPLICATIONS

This application claims priority to French Patent Application No. 23/11340, filed on Oct. 19, 2023, which is incorporated by reference herein in its entirety.

FIELD OF THE INVENTION

The present invention relates to a variable-speed refrigerating scroll compressor with a device for controlling oil injection into the compression volume.

BACKGROUND ART

During an operation of a scroll compressor, an orbiting scroll and a fixed scroll define a plurality of pockets, also named compression chambers, in which a refrigerant is being compressed. An oil circulation ratio (OCR) level is very important for the scroll compressor to ensure good sealing between the pockets. If the OCR is too low, internal leakages between the successive pockets increase and an efficiency of the scroll compressor is negatively affected. On the other hand, if the OCR is too high it leads to decrease in thermodynamic efficiency of compression as there is too much oil in relation to the refrigerant. Therefore, it is required to ensure a proper OCR level during the operation of the scroll compressor.

The OCR level may be generated in a natural way (when oil droplets are dragged from a low pressure side of a scroll compressor by a refrigerant flow) or by some additional equipment (e.g. by additional oil injectors). In fixed-speed refrigerating scroll compressors, the amount of the OCR generated in the natural way may be calculated, and if the natural-generated OCR level is not sufficient, additional oil may be delivered.

The OCR level depends also on the operating conditions: at low evaporating temperature, the refrigerant density is low and less oil droplets are dragged. In contrary, at high evaporating temperatures, the refrigerant density is high which results in that more oil droplets are dragged. However, this effect is secondary and may only act on the OCR level by 1 or 2% at most.

JP2003286976A discloses a scroll compressor with oil delivery holes delivering a lubricating oil to a compression stage of the scroll compressor. The amount of oil being delivered may be adjusted by a hole diameter, which corresponds to an optimum lubricating oil supply amount. Such a solution provides a constant oil delivery flow and is always active.

Things get complicated for variable-speed refrigerating scroll compressors. In this type of scroll compressors, the OCR level generated in the natural way varies depending on an operational speed of the scroll compressor. When the scroll compressor operates at a low speed, a speed of refrigerant flow flowing through the scroll compressor is low and therefore the amount of oil droplets dragged by the refrigerant flow is low. Therefore, at low speed of the scroll compressor, there is a need for additional oil delivery. On the other hand, when the scroll compressor operates at high speed, a speed of a refrigerant flow flowing through the scroll compressor is high and therefore the amount of oil droplets dragged by the refrigerant flow is high. Therefore, at the high speed of the scroll compressor, there is no need for additional oil delivery. Thus, there is a need for a solution with a variable oil delivery flow.

FR2984425A1 discloses a scroll compressor with an oil injection device including an oil pump. Such solution provides a variable oil delivery flow but requires an additional equipment and therefore is complex and expensive.

CN201443509U discloses a scroll compressor with a device for controlling an oil delivery with an oil passage. The device is installed in an orbiting scroll. The amount of oil passing through the oil passage is controlled by controlling a closing time of an oil hole. Such solution is very complex and expensive. Furthermore, there is a big limitation on space within an orbiting scroll. Moreover, since the device is located in the orbiting scroll, it is exposed on a sinusoidal centrifugal load as the orbiting scroll motion is an orbit, making it difficult to develop.

Finally, FR2919688A1, which is regarded as the closest prior art for the present invention, discloses a variable-speed refrigerating scroll compressor comprising an oil injection circuit arranged to inject oil into a compression volume, wherein the oil injection circuit comprises a moving blocking piece, operated by centrifugal force, between a first position freeing the oil injection means and enabling oil injection into the compression volume and a second position blocking the oil injection means and preventing oil injection into the compression volume, the blocking piece is arranged to be displaced into its second position when the speed of the scroll compressor exceeds a predetermined value.

However, the moving blocking piece is pressed against an orbiting scroll by a spring and therefore it is in a constant sliding contact with the orbiting scroll. Thus, this solution is exposed to an excessive wear. Secondly, it is difficult to maintain a proper sealing between the moving blocking piece and the orbiting scroll over a lifetime of the scroll compressor.

Moreover, FR2919688A1 does not provide a reliable solution for ensuring a proper lubrication for the contact surface between the orbiting scroll and the housing configured to handle the axial load from compressed gas while ensuring orbiting motion of the orbiting scroll. Since an opening for delivering oil to the compression stage is basically in line with the rotation axis of the drive shaft, it may happen that the most of the oil passing through an oil feed channel provided on the drive shaft will go directly for oil injection into the compression stage and as a result, there will be an oil starvation for this contact surface.

Furthermore, assembling the moving blocking piece at the upper part of the drive shaft requires applying a preload to the spring configured to cooperate with moving blocking piece and therefore it is at least slightly difficult.

SUMMARY OF THE INVENTION

It is an object of the present invention to overcome the above-mentioned drawbacks from the prior art solutions and provide a simple, reliable and cheap solution for ensuring a proper OCR level during operation of a variable-speed scroll compressor.

According to the present invention, there is provided a scroll compressor including:

- a compressor casing provided with a suction fitting configured to supply the scroll compressor with refrigerant gas to be compressed and a discharge fitting configured to discharge compressed refrigerant gas,
- a compression unit mounted inside the compressor casing and configured to compress the refrigerant gas supplied by the suction fitting, the compression unit including a fixed scroll and an orbiting scroll configured to perform an orbiting movement relative to the fixed scroll during operation of the scroll compressor, the fixed scroll and the orbiting scroll defining a compression volume, an oil sump disposed inside the compressor casing, a drive shaft disposed inside the compressor casing and including a driving portion coupled with the orbiting scroll and configured to drive the orbiting scroll in an orbital movement, the drive shaft being rotatable around a rotation axis, a variable-speed electric motor disposed inside the compressor casing and configured to rotatably drive the drive shaft, an oil injection system configured to inject oil at least into the compression volume, the oil injection system including an oil feed channel fluidly connected to the oil sump and extending over the entire length of the drive shaft, and oil injection means provided on the orbiting scroll and configured to deliver oil from the oil feed channel to the compression volume, and an oil flow regulating device configured to regulate, i.e. to control, an oil flow from the oil feed channel to the oil injection means, the oil flow regulating device including:

a mounting body mounted at an upper end face of the driving portion, wherein the upper end face of the driving portion and the mounting body define a first volume in flow communication with the oil feed channel of the drive shaft, and the mounting body and the orbiting scroll at least partially define a second volume in flow communication with the oil injection means, an oil passage opening formed in the mounting body and through which the first volume and the second volume are configured to be in flow communication with each other, and an oil flow regulating member movable between a first position at a first speed of the variable-speed electric motor and a second position at a second speed of the variable-speed electric motor being higher than the first speed, wherein the oil flow regulating member allows an oil flow through the oil passage opening when the oil flow regulating member is in the first position and limits the oil flow through the oil passage opening when the oil flow regulating member is in the second position.

Due to the presence of the first and second volumes, the oil flow regulating device according to the present invention is not in a sliding contact with the orbiting scroll. Therefore, a lifetime and reliability of the oil flow regulating device, and thus of the scroll compressor comprising such an oil flow regulating device, are improved.

In addition, the configuration of the oil flow regulating device according to the present invention ensures a easy mounting of the oil flow regulating device on the drive shaft, and thus simplifies the assembly of the scroll compressor of the present invention.

Moreover, the size (diameter) of the oil injection means can be significantly increased to improve even more the oil injection flowrate at low speed of a compressor, as the flow through the oil injection means is prevented at high speed of a compressor.

According to an embodiment of the invention, the mounting body comprises a base wall and a peripheral wall extending from the base wall towards the drive shaft.

According to an embodiment of the invention, the peripheral wall and the oil flow regulating member define therebetween a variable oil flow channel, i.e. an oil flow channel having a variable flow cross section.

According to an embodiment of the invention, the base wall extends substantially perpendicular to the rotation axis of the drive shaft.

According to an embodiment of the invention, the upper end face of the driving portion includes an annular fixing groove in which is secured the mounting body, and particularly the peripheral wall of the mounting body.

According to an embodiment of the invention, the oil feed channel emerges in the upper end face of the driving portion. Advantageously, an upper end of the oil feed channel is facing the base wall of the mounting body.

According to an embodiment of the invention, the oil feed channel emerges in the first volume.

According to an embodiment of the invention, the fixed scroll includes a fixed base plate and a fixed spiral wrap, and the orbiting scroll includes an orbiting base plate and an orbiting spiral wrap, the fixed spiral wrap and the orbiting spiral wrap forming a plurality of compression chambers. Advantageously, the oil injection means are provided on the orbiting base plate.

According to an embodiment of the invention, the first volume, being in fluid communication with the oil feed channel, is defined by the base wall, the peripheral wall and the drive shaft.

According to an embodiment of the invention, the second volume, being in fluid communication with the oil injection means, is defined by the mounting body, the orbiting scroll and the drive shaft.

According to an embodiment of the invention, the base wall of the mounting body is circular.

According to an embodiment of the invention, the peripheral wall of the mounting body has a cylindrical shape.

According to an embodiment of the invention, the oil passage opening is formed in the peripheral wall of the mounting body. Such location of the oil passage opening limits the risk of the oil flowing directly from the oil feed channel into the second volume, and thus ensures a proper lubrication of a shaft bearing at low speed of the variable-speed electric motor.

According to an embodiment of the invention, the oil passage opening extends circumferentially on the peripheral wall of the mounting body.

According to an embodiment of the invention, the oil passage opening is oblong in a circumferential direction. The oil passage opening may have a rectangular shape.

According to an embodiment of the invention, the oil flow regulating member is configured to prevent an oil flow through the oil passage opening when the oil flow regulating member is in the second position. Particularly, the oil flow regulating member is configured to tightly close the oil passage opening when the oil flow regulating member is in the second position. Such a configuration of the oil flow regulating member ensures that no oil is injected into the compression volume at high (second) speed of the scroll compressor and therefore improves the efficiency.

According to an embodiment of the invention, the oil flow regulating member is configured to be moved from the first position to the second position under operation of a centrifugal force, i.e. when the centrifugal force acting on the oil flow regulating member is higher than a predetermined threshold force.

According to an embodiment of the invention, the oil flow regulating member is elastically deformable between the first and second positions, and is provided with a fixed first end and a free second end.

According to an embodiment of the invention, the oil flow regulating member has a curved shape.

According to an embodiment of the invention, the oil flow regulating member has at least two separate sections with different elasticities. Through a multiple sections with different elasticities, it is possible to obtain a variable characteristic of the oil flow regulating member. For example, the oil flow regulating member may be configured to move quickly from the first position to an intermediate position when the speed of the variable-speed electric motor increases from the first speed to a higher intermediate speed (and therefore quickly impacting the oil flow rate through the oil passage opening), and to move slowly from the intermediate position to the second position when the speed of the variable-speed electric motor increases from the intermediate speed to the second speed (and therefore slowly impacting the oil flow rate through the oil passage opening and providing a smooth closing of the oil passage opening).

According to an embodiment of the invention, the oil flow regulating member includes a mass member attached at the free second end.

According to an embodiment of the invention, the oil flow regulating member has a shape which at least partially corresponds to the one of the peripheral wall at least when the oil flow regulating member is in the second position. With such a shape of the oil flow regulating member, the oil passage opening may be closed tightly in fluid manner without a need of any additional sealing members.

According to an embodiment of the invention, the scroll compressor further includes a support arrangement including a thrust bearing surface on which is slidably mounted the orbiting scroll, the oil injection system being configured to lubricate the thrust bearing surface with oil supplied from the oil feed channel.

According to an embodiment of the invention, the oil injection system includes a thrust bearing lubrication channel formed in the drive shaft and being in flow communication with the first volume.

According to an embodiment of the invention, the thrust bearing lubrication channel includes an oil inlet aperture emerging in the upper end face of the driving portion and being in flow communication with the first volume, and an oil outlet aperture emerging in a circumferential outer surface of the driving portion.

According to an embodiment of the invention, when the oil flow regulating member is in the first position, the oil flow regulating member extends, viewed from above, at least partially between the oil passage opening and the upper end of the oil feed channel. Therefore, when the oil flow regulating member is in the first position, the oil flow regulating member forms an oil deflector for at least a part of the oil coming out of the oil feed channel.

According to an embodiment of the invention, the oil passage opening and the oil inlet aperture of the thrust bearing lubrication channel are each angularly located with respect to the rotation axis of the drive shaft such that, when the oil flow regulating member is in the first position, the oil from the oil feed channel is delivered in priority to the thrust bearing lubrication channel rather than to the oil passage opening. In other words, the oil passage opening and the oil inlet aperture of the thrust bearing lubrication channel are each angularly located with respect to the rotation axis of the drive shaft such that, when the oil flow regulating member is in the first position, the oil coming out of the oil feed channel first reaches the thrust bearing lubrication channel before reaching the oil passage opening. Such a configuration of the scroll compressor ensures a reliable, constant oil supply notably to the thrust bearing surface and prevents oil starvation for the latter.

According to an embodiment of the invention, the oil passage opening and the oil inlet aperture of the thrust bearing lubrication channel are angularly offset relative to the rotation axis of the drive shaft.

According to an embodiment of the invention, the oil inlet aperture is located in a first half-space defined by a reference plane including the central axis of the driving portion and the rotation axis of the drive shaft, and the oil passage opening is located in a second half-space defined by the reference plane.

According to an embodiment of the invention, the oil inlet aperture and the oil passage opening are substantially diametrically opposed with respect to the rotation axis of the drive shaft.

According to an embodiment of the invention, the scroll compressor further includes an upper counterweight connected to the driving portion and configured to at least partially balance the mass of the orbiting scroll.

According to an embodiment of the invention, the oil injection system further includes an oil supplying passage at least partially defined by the upper counterweight and configured to be supplied with oil from the thrust bearing lubrication channel, the oil supplying passage being configured to supply the thrust bearing surface with oil.

According to an embodiment of the invention, the orbiting scroll further includes a cylindrical hub in which the driving portion of the drive shaft is at least partially mounted.

According to an embodiment of the invention, the scroll compressor also includes a hub bearing provided in the cylindrical hub and configured to cooperate with the driving portion of the drive shaft.

According to an embodiment of the invention, the oil flow regulating member is fixed to the mounting body, and for example to the peripheral wall of the mounting body.

According to another embodiment of the invention, the oil flow regulating member is fixed to the drive shaft.

According to an embodiment of the invention, the oil flow regulating member is located in the mounting body, and particularly in the first volume.

According to an embodiment of the invention, the mounting body is press-fitted on the driving portion of the drive shaft.

According to an embodiment of the invention, the scroll compressor further includes an indexing device configured to define a single angular position of the mounting body relative to the driving portion.

According to an embodiment of the invention, the indexing device includes a protruding member provided on the driving portion and protruding from the upper end face of the driving portion, and a receiving hole provided on the mounting body and in which is received the protruding member.

According to an embodiment of the invention, the receiving hole is provided on the base wall of the mounting body.

According to an embodiment of the invention, the protruding member is centered on the rotation axis of the drive shaft.

According to an embodiment of the invention, the oil injection means comprise at least one injection channel provided on an orbiting base plate of the orbiting scroll and in fluid communication with the second volume, and at least one injection orifice provided on the orbiting base plate of the orbiting scroll and being in fluid communication with the at least one injection channel, the at least one injection orifice emerging in the compression volume.

According to an embodiment of the invention, the at least one injection orifice emerges in an upper face of the orbiting base plate.

According to an embodiment of the invention, the diameter of the at least one injection orifice is about 3 mm.

According to an embodiment of the invention, the drive shaft includes an upper guided portion adjacent to the driving portion and a lower guided portion opposite to the upper guided portion, and the scroll compressor further includes an upper main bearing provided on the support arrangement and configured to guide in rotation the upper guided portion of the drive shaft, and a lower main bearing configured to guide in rotation the lower guided portion of the drive shaft.

According to an embodiment of the invention, the oil injection system is configured to lubricate at least partially the upper main bearing and/or the hub bearing with oil supplied from the oil feed channel.

BRIEF DESCRIPTION OF THE DRAWINGS

The following detailed description of an embodiment of the invention is better understood when read in conjunction with the appended drawings being understood, however, that the invention is not limited to the specific embodiment disclosed.

DESCRIPTION OF THE PREFERRED EMBODIMENT OF THE INVENTION

Figure 1:
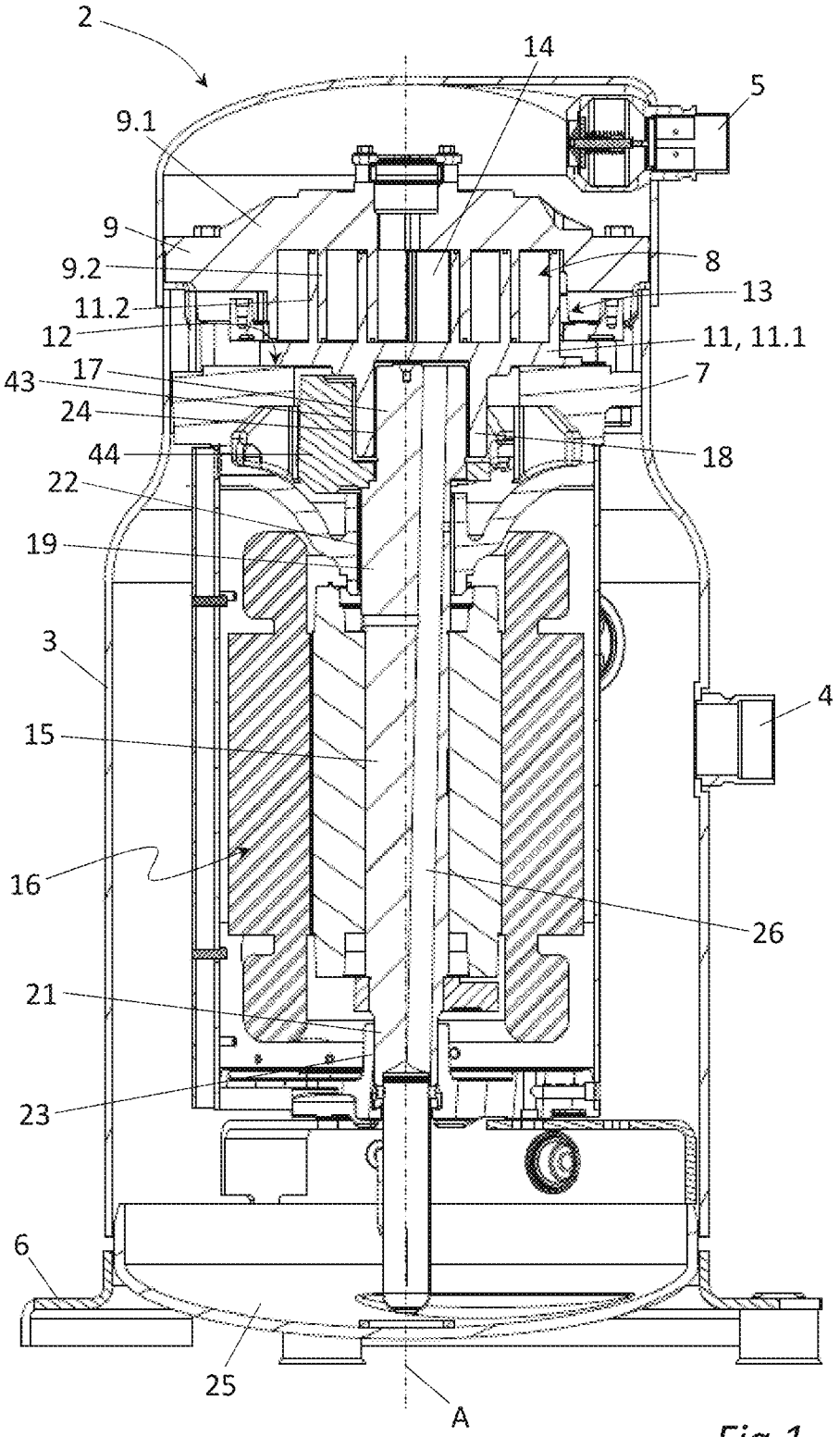
FIG. 1 is a longitudinal section view of a scroll compressor according to an embodiment of the invention.

FIG. 1 shows a longitudinal section view of a scroll compressor 2 according to an embodiment of the present invention.

The scroll compressor 2 includes a compressor casing 3 provided with a suction fitting 4 configured to supply the scroll compressor 2 with refrigerant gas to be compressed and a discharge fitting 5 configured to discharge compressed refrigerant gas.

The scroll compressor further includes a baseplate 6 secured to the compressor casing 3 and providing a stable support for the scroll compressor 2.

The scroll compressor 2 further includes a support arrangement 7 arranged within the compressor casing 3 and secured to the compressor casing 3, and a compression unit 8 also arranged within the compressor casing 3 and disposed above the support arrangement 7. The compression unit 8 is configured to compress the refrigerant gas supplied by the suction fitting 4, and includes a fixed scroll 9, which is fixed in relation to the compressor casing 3, and an orbiting scroll 11 configured to perform an orbiting movement relative to the fixed scroll 9 during operation of the scroll compressor 2. Advantageously, the orbiting scroll 11 is supported by and in slidable contact with a thrust bearing surface 12 provided on the support arrangement 7, and the fixed scroll 9 and the orbiting scroll 11 defines a compression volume 13.

Particularly, the fixed scroll 9 includes a fixed base plate 9.1 having a lower face oriented towards the orbiting scroll 11, and an upper face opposite to the lower face of the fixed base plate 9.1. The fixed scroll 9 also includes a fixed spiral wrap 9.2 projecting from the lower face of the fixed base plate 9.1 towards the orbiting scroll 11.

The orbiting scroll 11 includes an orbiting base plate 11.1 having an upper face oriented towards the fixed scroll 9, and a lower face opposite to the upper face of the orbiting base plate 11.1 and slidably mounted on the thrust bearing surface 12. The orbiting scroll 11 also includes an orbiting spiral wrap 11.2 projecting from the upper face of the orbiting base plate 11.1 towards the fixed scroll 9. The orbiting spiral wrap 11.2 of the orbiting scroll 11 meshes with the fixed spiral wrap 9.2 of the fixed scroll 9 to form a plurality of compression chambers 14 between them. Each of the compression chambers 14 has a variable volume which decreases from the outside towards the inside, when the orbiting scroll 11 is driven to orbit relative to the fixed scroll 9.

The scroll compressor 2 further includes a drive shaft 15 disposed inside the compressor casing 3 and configured to drive the orbiting scroll 11 in an orbital movement, and a variable-speed electric motor 16 disposed inside the compressor casing 3 and coupled to the drive shaft 15. The variable-speed electric motor 16 is particularly configured to drive in rotation the drive shaft 15 about a rotation axis A. According to the embodiment shown on the Figures, the variable-speed electric motor 16 is disposed below the support arrangement 7.

The drive shaft 15 includes, at its upper end, a driving portion 17 which is offset from the longitudinal axis of the drive shaft 15 (and thus which is eccentric in relation to the remaining part of the drive shaft 15), and which is partially mounted in a cylindrical hub 18 provided on the orbiting scroll 11 and projecting downwards from the orbiting base plate 11.1. The driving portion 17 is configured to cooperate with the cylindrical hub 18 so as to drive the orbiting scroll 11 in an orbital movement relative to the fixed scroll 9 when the variable-speed electric motor 16 is operated.

The drive shaft 15 also includes an upper guided portion 19 adjacent to the driving portion 17 and a lower guided portion 21 opposite to the upper guided portion 19, and the scroll compressor 2 further includes an upper main bearing 22 provided on the support arrangement 7 and configured to guide in rotation the upper guided portion 19 of the drive shaft 15, and a lower main bearing 23 configured to guide in rotation the lower guided portion 21 of the drive shaft 15. The scroll compressor 2 also includes a hub bearing 24 provided in the cylindrical hub 18 and configured to cooperate with the driving portion 17 of the drive shaft 15.

The scroll compressor 2 also includes an oil sump 25 arranged inside the compressor casing 3 and configured to store oil. The oil sump 25 may for example be at least partially delimited by a bottom portion of the compressor casing 3.

Furthermore, the scroll compressor 2 includes an oil injection system configured to inject oil at least into the compression volume 13.

The oil injection system particularly includes an oil feed channel 26 fluidly connected to the oil sump 25 and extending over the entire length of the drive shaft 15. Advantageously, the oil feed channel 26 has an upper end which emerges in an upper end face 17.1 (see FIG. 3) of the driving portion 17 which is oriented towards the orbiting scroll 11. The oil feed channel 26 is inclined with respect to the longitudinal axis of the drive shaft 15, and is particularly configured to supply upper parts of the scroll compressor 2 with oil from the oil sump 25.

The oil injection system also includes oil injection means provided on the orbiting scroll 11, and particularly on the orbiting base plate 11.1, and configured to deliver oil from the oil feed channel 26 to the compression volume 13.

Figure 2:
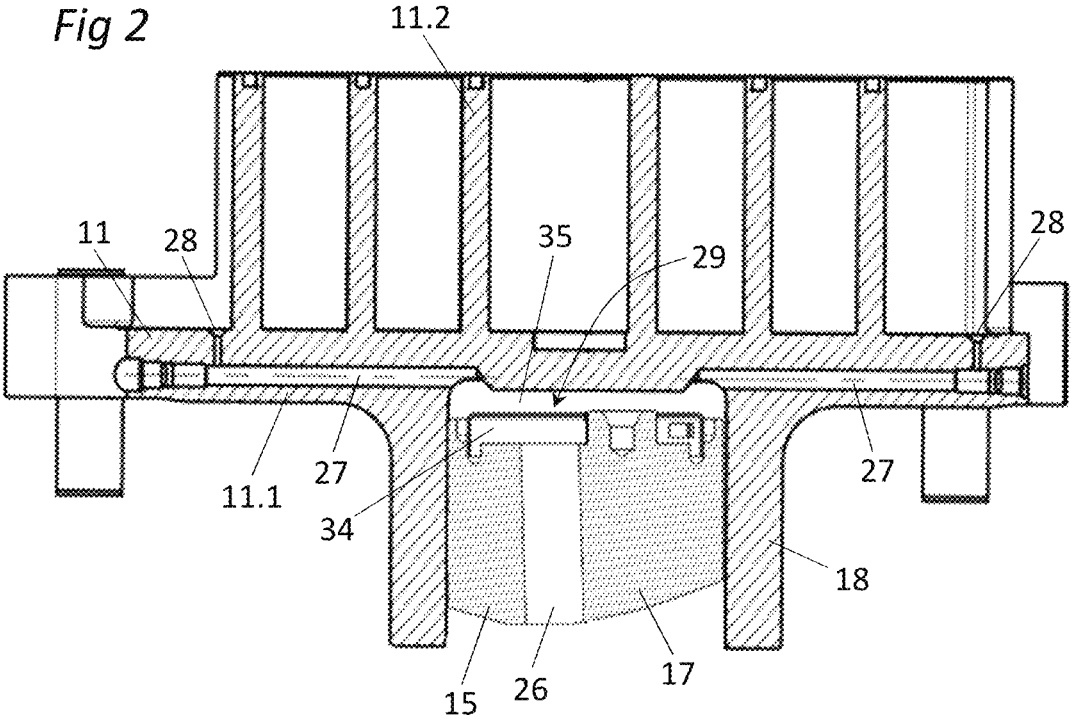
FIG. 2 is a partial longitudinal section view of the scroll compressor of FIG. 1.

According to the embodiment shown in FIG. 2, the oil injection means comprise several injection channels 27 provided on the orbiting base plate 11.1 and each being configured to be fluidly connected to the oil feed channel 26, and several injection orifices 28 provided on the orbiting base plate 11.1 and each being in fluid communication with a respective injection channel 27. Advantageously, each injection channel 27 is rectilinear, and each injection orifice 28 emerges in the compression volume 13, and particularly in the upper face of the orbiting base plate 11.1.

Moreover, the scroll compressor 2 includes an oil flow regulating device 29 configured to regulate an oil flow from the oil feed channel 26 to the oil injection means.

Figure 3:
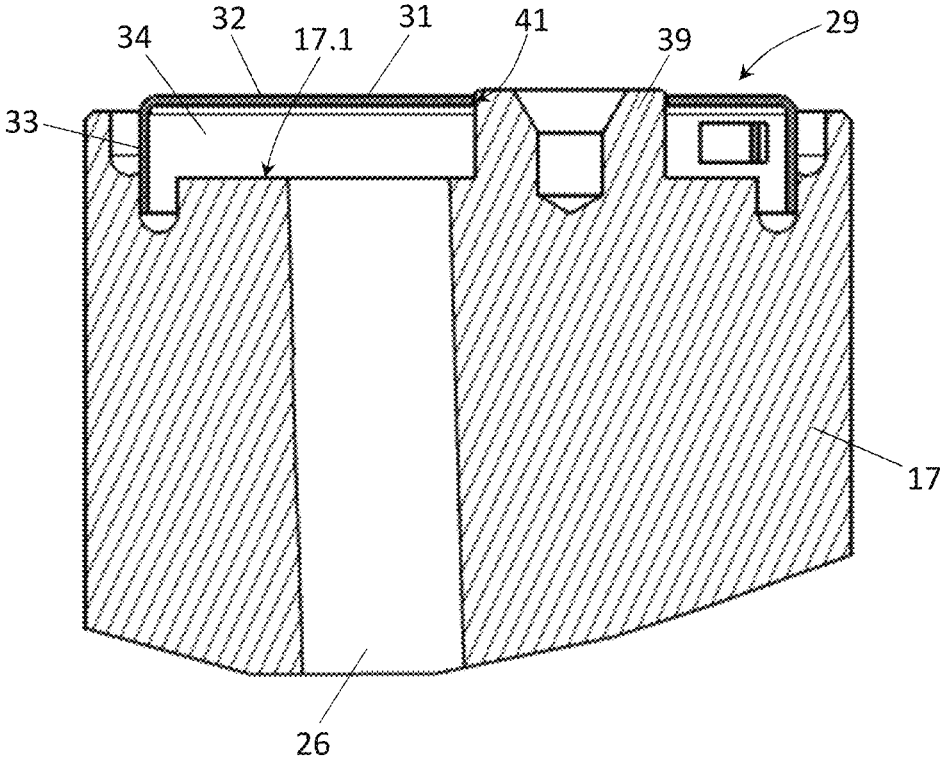
FIG. 3 is an enlarged view of a detail of FIG. 2.

As better shown on FIG. 3, the oil flow regulating device 29 includes a mounting body 31 mounted at the upper end face 17.1 of the driving portion 17, and for example press-fitted on the driving portion 17 of the drive shaft 15. According to the embodiment shown in FIGS. 3-8, the mounting body 31 comprises a base wall 32 which is circular and extends perpendicular to the rotation axis A of the drive shaft 15, and a peripheral wall 33 having a cylindrical shape and extending from the base wall 32 towards the drive shaft 15. The upper end face 17.1 of the driving portion 17 may for example include an annular fixing groove in which is secured the peripheral wall 33 of the mounting body 31. Advantageously, the upper end of the oil feed channel 26 is facing the base wall 32 of the mounting body 31.

The upper end face 17.1 of the driving portion 17 and the mounting body 31 define a first volume 34 in flow communication with the oil feed channel 26 of the drive shaft 15, and the mounting body 31 and the orbiting scroll 11 at least partially define a second volume 35 (see FIG. 2) in flow communication with the oil injection means. According to the embodiment shown in the Figures, the first volume 34 is defined by the base wall 32, the peripheral wall 33 and the upper end face 17.1 of the drive shaft 15, and the second volume 35 is defined by the mounting body 31, the orbiting scroll 11 and the drive shaft 15. Particularly, the oil feed channel 26 emerges in the first volume 34, and each injection channel 27 emerges in the second volume 35.

The oil flow regulating device 29 further includes an oil passage opening 36 formed in the mounting body 31 and through which the first volume 34 and the second volume 35 are configured to be in flow communication with each other. According to the embodiment shown on the figures, the oil passage opening 36 is formed in the peripheral wall 33 of the mounting body 31, and is axially offset with respect to the upper end face 17.1 of the drive shaft 15. Advantageously, the oil passage opening 36 is oblong in a circumferential direction, and has for example a rectangular shape.

The oil flow regulating device 29 also includes an oil flow regulating member 37 movable between a first position (shown e.g. in FIG. 6) at a first speed of the variable-speed electric motor 16 and a second position (not shown in the Figures) at a second speed of the variable-speed electric motor 16 being higher than the first speed. Advantageously, the oil flow regulating member 37 allows an oil flow through the oil passage opening 36 when the oil flow regulating member 37 is in the first position and prevents the oil flow through the oil passage opening 36 when the oil flow regulating member 37 is in the second position. Particularly, the oil flow regulating member 37 is configured to tightly close the oil passage opening 36 when the oil flow regulating member 37 is in the second position.

Figure 7:
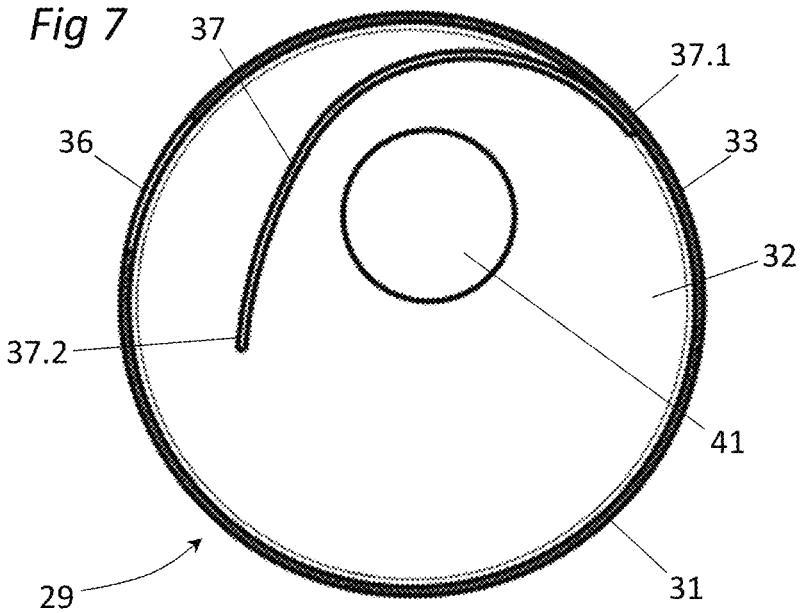
FIG. 7 is a bottom view of the oil flow regulating device of FIG. 5.

As shown in FIG. 7, when the oil flow regulating member 37 is in the first position, the oil flow regulating member 37 extends, viewed from above, at least partially between the oil passage opening 36 and the upper end of the oil feed channel 26.

According to the embodiment shown in the Figures, the oil flow regulating member 37 has a curved shape, and is provided with a fixed first end 37.1 and a free second end 37.2. The oil flow regulating member 37 may for example be located in the first volume 34, and particularly in the mounting body 31, and the fixed first end 37.1 of the oil flow regulating member 37 may for example be secured to the peripheral wall 33 of the mounting body 31.

Advantageously, the oil flow regulating member 37 is elastically deformable between the first and second positions, and is configured to be moved from the first position to the second position under operation of a centrifugal force, i.e. when the centrifugal force acting on the oil flow regulating member 37 is higher than a predetermined threshold force. Advantageously, the oil flow regulating member 37 has a shape which at least partially corresponds to the one of the peripheral wall 33 at least when the oil flow regulating member 37 is in the second position. With such a shape of the oil flow regulating member 37, the oil passage opening 36 may be closed tightly in fluid manner without a need of any additional sealing members, when the oil flow regulating member 37 is in the second position.

Figure 6:
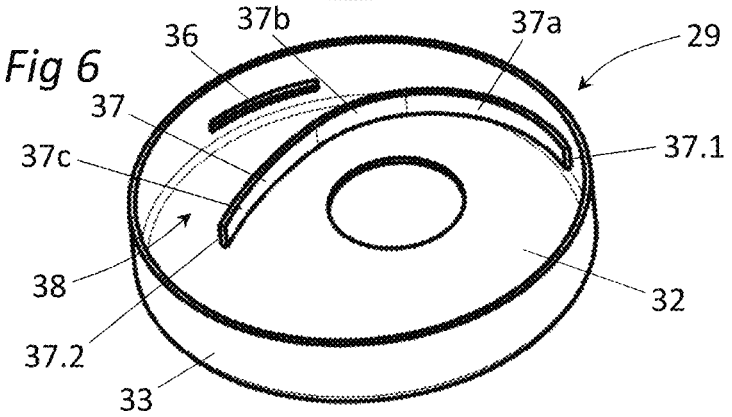
FIG. 6 is a perspective bottom view of the oil flow regulating device of FIG. 5.

As shown in FIG. 6, oil flow regulating member 37 may include a first section 37*a*, a second section 37*b* and a third section 37*c* which are longitudinally offset from each other and which have different elasticities, such that each of the first, second and third sections 37*a* to 37*c* deforms under operation of a centrifugal force with a different rate/level. For example, the first section 37*a* has the lowest elasticity, the second section 37*b* has a middle elasticity and the third section 37*c* has the highest elasticity. In such scenario, during the operation of the scroll compressor 2, firstly the third section 37*c* will begin to deform, then the second section 37*b* and finally the first section 37*a*. Thus, a variable oil flow channel 38 between the peripheral wall 33 and the oil flow regulating member 37 may be obtained and the oil flow control though the oil passage opening 36 is further improved.

Figure 4:
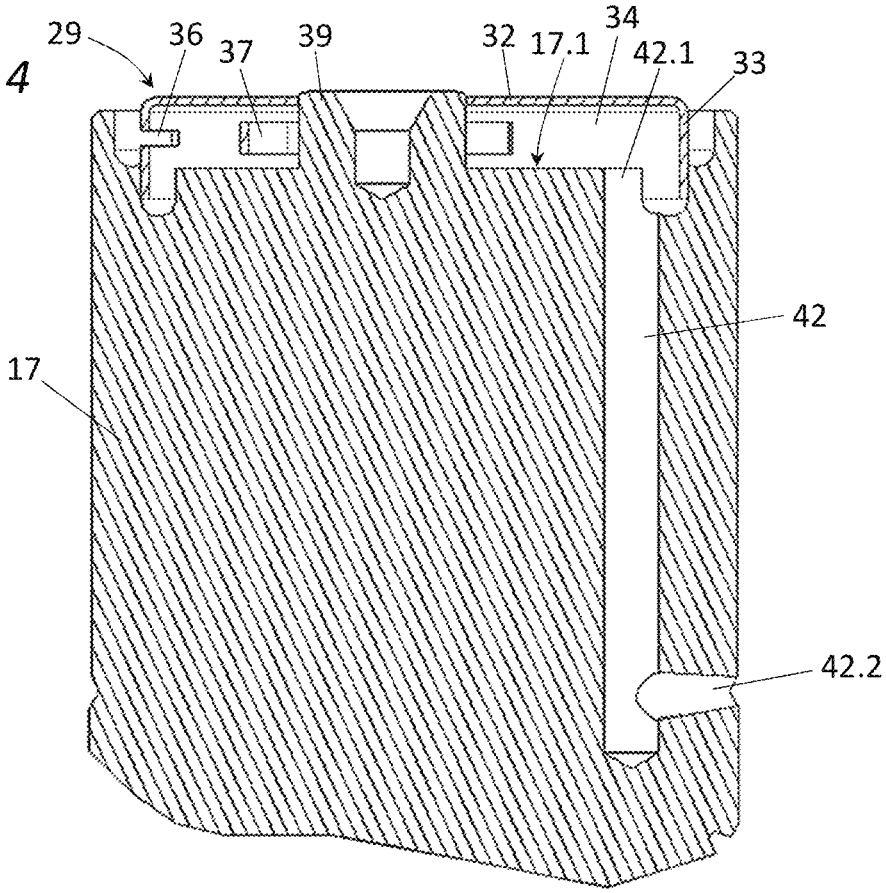
FIG. 4 is a partial longitudinal section view of the scroll compressor of FIG. 1 taken along a sectional plane angularly shifted from the one of FIG. 2.
Figure 5:
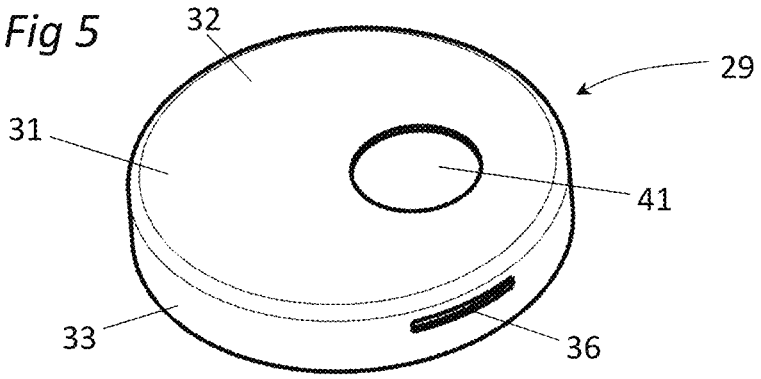
FIG. 5 is a perspective top view of an oil flow regulating device of the scroll compressor of FIG. 1.

As best shown in FIGS. 3 and 4, the scroll compressor 2 further includes an indexing device configured to define a single angular position of the mounting body 31 relative to the driving portion 17. According to the embodiment shown in the Figures, the indexing device includes a protruding member 39 provided on the driving portion 17 and protruding from the upper end face 17.1 of the driving portion 17, and a receiving hole 41 provided on the base wall 32 of the mounting body 31 and in which is received the protruding member 39. Advantageously, the receiving hole 41 is laterally offset with respect to a central axis of the base wall 32, and the protruding member 39 is laterally offset with respect to a central axis B of the driving portion 17 and may for example be centered on the rotation axis A of the drive shaft 15.

Advantageously, the oil injection system is also configured to lubricate the thrust bearing surface 12 with oil supplied from the oil feed channel 26.

Figure 8:
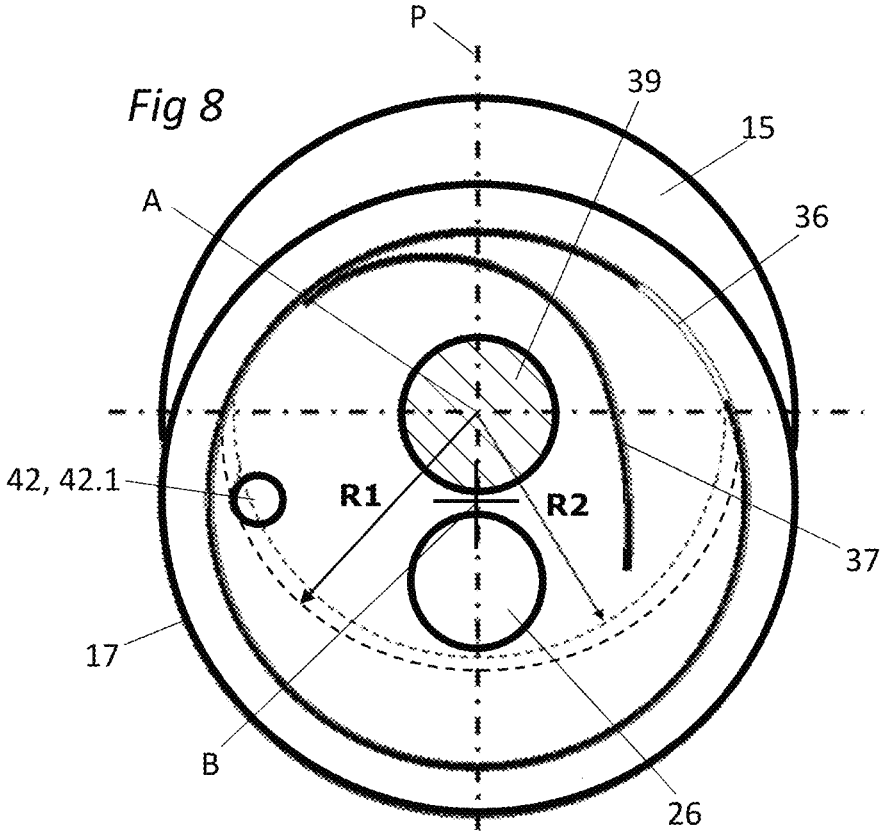
FIG. 8 is a cross-section view of a drive shaft of the scroll compressor of FIG. 1 provided with the oil flow regulating device of FIG. 5.

As best shown in FIGS. 4 and 8, the oil injection system includes a thrust bearing lubrication channel 42 which is formed in the drive shaft 15 and which is in flow communication with the first volume 34. According to the embodiment shown in the Figures, the thrust bearing lubrication channel 42 includes an oil inlet aperture 42.1 emerging in the upper end face 17.1 of the driving portion 17 and being in flow communication with the first volume 34, and an oil outlet aperture 42.2 emerging in a circumferential outer surface of the driving portion 17.

The oil injection system also comprises an oil supplying passage 43 (see FIG. 1) which is at least partially defined by an upper counterweight 44, connected to the driving portion 17 and configured to at least partially balance the mass of the orbiting scroll 11, and which is configured to be supplied with oil from the oil outlet aperture 42.2 of the thrust bearing lubrication channel 42. The oil supplying passage 43 is particularly configured to supply the thrust bearing surface 12 with oil from the thrust bearing lubrication channel 42.

The thrust bearing lubrication channel 42 and the oil supplying passage 43 are configured such that part of the oil located inside the first volume 34 can flow towards the upper counterweight inner diameter thanks to centrifugal load, and then be ejected at the top of the upper counterweight towards the thrust bearing surface 12.

Advantageously, the oil passage opening 36 and the oil inlet aperture 42.1 of the thrust bearing lubrication channel 42 are angularly offset relative to the rotation axis A of the drive shaft 15 and are angularly located with respect to the rotation axis A of the drive shaft 15 such that, when the oil flow regulating member 37 is in the first position, the oil from the oil feed channel 26 is delivered in priority to the thrust bearing lubrication channel 42 rather than to the oil passage opening 36. In other words, the oil passage opening 36 and the oil inlet aperture 42.1 of the thrust bearing lubrication channel 42 are angularly located with respect to the rotation axis A of the drive shaft 15 such that, when the oil flow regulating member 37 is in the first position, the oil coming out of the oil feed channel 26 first reaches the thrust bearing lubrication channel 42 before reaching the oil passage opening 36. Such a configuration of the scroll compressor 2 ensures a reliable, constant oil supply notably to the thrust bearing surface 12 and prevents oil starvation for the latter.

According to the embodiment shown in FIG. 8, the oil inlet aperture 42.1 is located in a first half-space defined by a reference plane P including the central axis B of the driving portion 17 and the rotation axis A of the drive shaft 15, and the oil passage opening 36 is located in a second half-space defined by the reference plane P. For example, the oil inlet aperture 42.1 and the oil passage opening 36 may be substantially diametrically opposed with respect to the rotation axis A of the drive shaft 15.

During the operation of the scroll compressor 2, oil is delivered from the oil sump 25 to the first volume 34 through the oil feed channel 26 in the drive shaft 15. The oil is spread in the first volume 34 with a circle centered on the rotation axis A of the drive shaft 15.

At the first speed (low speed) of the variable-speed electric motor 16 (i.e. when there is a small amount of the oil reaching the first volume 34), the oil free surface circle radius R1 is bigger than the oil free surface circle radius R2 at the second speed (high speed) of the variable-speed electric motor 16 (i.e. when there is a sufficient amount of the oil reaching the first volume 34). This is associated with the oil parabola inside the drive shaft 15. Advantageously, the angular location of the oil passage opening 36 is defined such that when the scroll compressor 2 operates at the first speed (or with low oil flow rate through the oil feed channel 26), the oil preferentially feeds the thrust bearing lubrication channel 42 rather than the oil passage opening 36, and ensures a proper lubrication of the shaft bearings. The oil can flow through the oil passage opening 36 only if there is enough extra oil coming out of the oil feed channel 26.

The oil passing through the oil passage opening 36 then enters the second volume 35 and is injected in the compression volume 13 via the injection channels 27 and the injection orifices 28, and ensure notably a proper lubrication of the compression unit 8.

At the second speed (high speed) of the variable-speed electric motor 16, the oil flow regulating member 37 is displaced, under operation of a centrifugal force, in the second position and tightly closes the oil passage opening 36, such that the oil, entering the first volume 34, can only exit said first volume 34 by flowing into the thrust bearing lubrication channel 42 (without reaching the second volume 35 and thus the oil injection means).

Advantageously, the oil injection system is also configured to lubricate at least partially the upper main bearing 22 and/or the hub bearing 24 with oil supplied from the oil feed channel 26, particularly through radial holes provided on the drive shaft 15 and emerging in the oil feed channel 26.

According to an embodiment of the invention not shown on the figures, the oil flow regulating member 37 may include a mass member attached at its free second end 37.2, and/or the oil flow regulating member 37 may be fixed to the drive shaft 15.

Of course, the invention is not restricted to the embodiments described above by way of non-limiting examples, but on the contrary it encompasses all embodiments thereof.

The invention claimed is:

1. A scroll compressor comprising:

a compressor casing provided with a suction fitting configured to supply the scroll compressor with refrigerant gas to be compressed and a discharge fitting configured to discharge compressed refrigerant gas, a compression unit mounted inside the compressor casing and configured to compress the refrigerant gas supplied by the suction fitting, the compression unit including a fixed scroll and an orbiting scroll configured to perform an orbiting movement relative to the fixed scroll during operation of the scroll compressor, the fixed scroll and the orbiting scroll defining a compression volume, an oil sump disposed inside the compressor casing, a drive shaft disposed inside the compressor casing and including a driving portion coupled with the orbiting scroll and configured to drive the orbiting scroll in an orbital movement, the drive shaft being rotatable around a rotation axis, a variable-speed electric motor disposed inside the compressor casing and configured to rotatably drive the drive shaft, an oil injection system configured to inject oil at least into the compression volume, the oil injection system including an oil feed channel fluidly connected to the oil sump and extending over the entire length of the drive shaft, and oil injection passages provided on the orbiting scroll and configured to deliver oil from the oil feed channel to the compression volume, and an oil flow regulating device configured to regulate an oil flow from the oil feed channel to the oil injection passages, the oil flow regulating device including:

a mounting body mounted at an upper end face of the driving portion, wherein the upper end face of the driving portion and the mounting body define a first volume in flow communication with the oil feed channel of the drive shaft, and the mounting body and the orbiting scroll are axially spaced and not in contact to at least partially define a second volume in flow communication with the oil injection passages, an oil passage opening formed in the mounting body and through which the first volume and the second volume are configured to be in flow communication with each other, and an oil flow regulating member movable between a first position at a first speed of the variable-speed electric motor and a second position at a second speed of the variable-speed electric motor being higher than the first speed, wherein the oil flow regulating member allows an oil flow through the oil passage opening when the oil flow regulating member is in the first position and limits the oil flow through the oil passage opening when the oil flow regulating member is in the second position.

2. The scroll compressor according to claim 1, wherein the mounting body is cylindrical and comprises a base wall and a radially outer peripheral wall.

3. The scroll compressor according to claim 2, wherein the oil passage opening is formed in the radially outer peripheral wall of the mounting body.

4. The scroll compressor according to claim 2, wherein the peripheral wall and the oil flow regulating member define therebetween a variable oil flow channel.

5. The scroll compressor according to claim 1, wherein the oil flow regulating member is configured to prevent an oil flow through the oil passage opening when the oil flow regulating member is in the second position.

6. The scroll compressor according to claim 1, wherein the oil flow regulating member is configured to be moved from the first position to the second position under operation of a centrifugal force.

7. The scroll compressor according to claim 1, wherein the oil flow regulating member is elastically deformable between the first and second positions, and is provided with a fixed first end and a free second end.

8. The scroll compressor according to claim 7, wherein the oil flow regulating member has a curved shape.

9. The scroll compressor according to claim 7, wherein the oil flow regulating member has at least two separate sections with different elasticities.

10. The scroll compressor according to claim 1, further comprising a support arrangement including a thrust bearing surface on which is slidably mounted the orbiting scroll, the oil injection system being configured to lubricate the thrust bearing surface with oil supplied from the oil feed channel.

11. The scroll compressor according to claim 10, wherein the oil injection system includes a thrust bearing lubrication channel formed in the drive shaft and being in flow communication with the first volume.

12. The scroll compressor according to claim 11, wherein the thrust bearing lubrication channel includes an oil inlet aperture emerging in the upper end face of the driving portion and being in flow communication with the first volume, and an oil outlet aperture emerging in a circumferential outer surface of the driving portion.

13. The scroll compressor according to claim 12, wherein the oil passage opening and the oil inlet aperture of the thrust bearing lubrication channel are each angularly located with respect to the rotation axis of the drive shaft such that, when the oil flow regulating member is in the first position, the oil from the oil feed channel is delivered in priority to the thrust bearing lubrication channel rather than to the oil passage opening.

14. The scroll compressor according to claim 1, wherein the oil flow regulating member is fixed to the mounting body.

15. The scroll compressor according to claim 1, wherein the oil injection passages comprise at least one injection channel provided on an orbiting base plate of the orbiting scroll and in fluid communication with the second volume, and at least one injection orifice provided on the orbiting base plate of the orbiting scroll and being in fluid communication with the at least one injection channel, the at least one injection orifice emerging in the compression volume.

16. The scroll compressor according to claim 1, wherein the oil flow regulating member is disposed in the first volume to limit flow outwardly of the oil passage opening.

17. The scroll compressor according to claim 1, wherein the mounting body is secured to the drive shaft.

18. A scroll compressor comprising:

a compressor casing provided with a suction fitting configured to supply the scroll compressor with refrigerant gas to be compressed and a discharge fitting configured to discharge compressed refrigerant gas, a compression unit mounted inside the compressor casing and configured to compress the refrigerant gas supplied by the suction fitting, the compression unit including a fixed scroll and an orbiting scroll configured to perform an orbiting movement relative to the fixed scroll during operation of the scroll compressor, the fixed scroll and the orbiting scroll defining a compression volume, an oil sump disposed inside the compressor casing, a drive shaft disposed inside the compressor casing and including a driving portion coupled with the orbiting scroll and configured to drive the orbiting scroll in an orbital movement, the drive shaft being rotatable around a rotation axis, a variable-speed electric motor disposed inside the compressor casing and configured to rotatably drive the drive shaft, an oil injection system configured to inject oil at least into the compression volume, the oil injection system including an oil feed channel fluidly connected to the oil sump and extending over the entire length of the drive shaft, and oil injection passages provided on the orbiting scroll and configured to deliver oil from the oil feed channel to the compression volume, and an oil flow regulating device configured to regulate an oil flow from the oil feed channel to the oil injection passages, the oil flow regulating device including:

a mounting body mounted at an upper end face of the driving portion, wherein the upper end face of the driving portion and the mounting body define a first volume in flow communication with the oil feed channel of the drive shaft, and the mounting body and the orbiting scroll at least partially define a second volume in flow communication with the oil injection passages, an oil passage opening formed in the mounting body and through which the first volume and the second volume are configured to be in flow communication with each other, an oil flow regulating member movable between a first position at a first speed of the variable-speed electric motor and a second position at a second speed of the variable-speed electric motor being higher than the first speed, wherein the oil flow regulating member allows an oil flow through the oil passage opening when the oil flow regulating member is in the first position and limits the oil flow through the oil passage opening when the oil flow regulating member is in the second position, and wherein the oil flow regulating member has a shape which at least partially corresponds to a radially outer peripheral wall on the mounting body at least when the oil flow regulating member is in the second position.

19. A scroll compressor comprising:

a compressor casing provided with a suction fitting configured to supply the scroll compressor with refrigerant gas to be compressed and a discharge fitting configured to discharge compressed refrigerant gas, a compression unit mounted inside the compressor casing and configured to compress the refrigerant gas supplied by the suction fitting, the compression unit including a fixed scroll and an orbiting scroll configured to perform an orbiting movement relative to the fixed scroll during operation of the scroll compressor, the fixed scroll and the orbiting scroll defining a compression volume, an oil sump disposed inside the compressor casing, a drive shaft disposed inside the compressor casing and including a driving portion coupled with the orbiting scroll and configured to drive the orbiting scroll in an orbital movement, the drive shaft being rotatable around a rotation axis, a variable-speed electric motor disposed inside the compressor casing and configured to rotatably drive the drive shaft, an oil injection system configured to inject oil at least into the compression volume, the oil injection system including an oil feed channel fluidly connected to the oil sump and extending over the entire length of the drive shaft, and oil injection passages provided on the orbiting scroll and configured to deliver oil from the oil feed channel to the compression volume, and an oil flow regulating device configured to regulate an oil flow from the oil feed channel to the oil injection passages, the oil flow regulating device including:

a mounting body mounted at an upper end face of the driving portion, wherein the upper end face of the driving portion and the mounting body define a first volume in flow communication with the oil feed channel of the drive shaft, and the mounting body and the orbiting scroll at least partially define a second volume in flow communication with the oil injection passages, an oil passage opening formed in the mounting body and through which the first volume and the second volume are configured to be in flow communication with each other, an oil flow regulating member movable between a first position at a first speed of the variable-speed electric motor and a second position at a second speed of the variable-speed electric motor being higher than the first speed, wherein the oil flow regulating member allows an oil flow through the oil passage opening when the oil flow regulating member is in the first position and limits the oil flow through the oil passage opening when the oil flow regulating member is in the second position, and further including an indexing device configured to define a single angular position of the mounting body relative to the driving portion.

20. The scroll compressor according to claim 19, wherein the indexing device includes a protruding member provided on the driving portion and protruding from the upper end face of the driving portion, and a receiving hole provided on the mounting body and in which is received the protruding member.

* * * * *